US009857753B2

(12) United States Patent
Hirahara et al.

(10) Patent No.: US 9,857,753 B2
(45) Date of Patent: Jan. 2, 2018

(54) IMAGE FORMING APPARATUS

(71) Applicant: KYOCERA Document Solutions Inc., Osaka (JP)

(72) Inventors: Kazuhisa Hirahara, Osaka (JP); Tetsuro Kawashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 19 days.

(21) Appl. No.: 15/073,723

(22) Filed: Mar. 18, 2016

(65) Prior Publication Data

US 2016/0282797 A1 Sep. 29, 2016

(30) Foreign Application Priority Data

Mar. 23, 2015 (JP) ..... 2015-059445

(51) Int. Cl.
*G03G 15/00* (2006.01)
*G03G 21/16* (2006.01)

(52) U.S. Cl.
CPC ..... *G03G 15/70* (2013.01); *G03G 21/1638* (2013.01); *G03G 2215/00552* (2013.01); *G03G 2215/0132* (2013.01); *G03G 2221/1675* (2013.01)

(58) Field of Classification Search
CPC ..... G03G 15/70; G03G 21/1638; G03G 21/1633; G03G 21/1647; G03G 15/30; G03G 2215/0132; G03G 2215/0552; G03G 2221/1675
See application file for complete search history.

(56) References Cited

U.S. PATENT DOCUMENTS 6,000,870 A * 12/1999 Koga ..... B41J 11/50 271/145
6,042,109 A * 3/2000 Klausbruckner ..... B41J 11/54 271/184
9,108,436 B1 * 8/2015 Yamamoto ..... B41J 2/325
2001/0040617 A1 * 11/2001 Yoshino ..... B41J 29/393 347/108
2003/0152401 A1 * 8/2003 Cornelius ..... G03G 15/2035 399/124
2011/0221124 A1 * 9/2011 Narikiyo ..... B65H 5/38 271/225

(Continued)

FOREIGN PATENT DOCUMENTS

JP 2005-031216 A 2/2005
JP 2013075764 A * 4/2013

*Primary Examiner* — David Banh
(74) *Attorney, Agent, or Firm* — Studebaker & Brackett PC

(57) ABSTRACT

An image forming apparatus includes a first conveying path, a second conveying path, a detector, a conveyance guide member and an interlock mechanism. The first conveying path communicates the second conveying path through which a sheet supplied from a supply part is conveyed. The detector detects whether or not the sheet is present in the first conveying path. The conveyance guide member composes the second conveying path and one end part thereof is pivotally supported so as to be able to open/close the second conveying path. The interlock mechanism interlocks the detector with the opening/closing operation of the conveyance guide member. The detector detects the opening/closing operation of the conveyance guide member.

8 Claims, 6 Drawing Sheets

(56) References Cited

U.S. PATENT DOCUMENTS

2012/0181741 A1* 7/2012 Suzuki ..... B65H 5/062
271/110
2013/0083112 A1* 4/2013 Sano ..... B41J 29/38
347/16
2015/0378292 A1* 12/2015 Katakura ..... G03G 15/6585
399/223

* cited by examiner

IMAGE FORMING APPARATUS

INCORPORATION BY REFERENCE

This application is based on and claims the benefit of priority from Japanese Patent application No. 2015-59445 filed on Mar. 23, 2015, the entire contents of which are incorporated herein by reference.

BACKGROUND

The present disclosure relates to a copying machine or a printer or the like including an image forming apparatus.

An image forming apparatus includes a conveying path configured to convey a sheet to an image forming port. The image forming apparatus also includes a mechanism removing (unjamming) a sheet jammed within the conveying path.

For instance, there is a printer including a sheet conveying part (conveying path) of a duplex printing part above a sheet cassette. A sheet guide member is provided so as to be able to open/close under the conveying path. The sheet guide member is lowered to a space from which the sheet cassette has been drawn out. This arrangement makes it possible to remove a jammed sheet. Still further, the sheet guide member is urged to a sheet guide position where the conveying path is closed by a torsion spring. An upper surface of aside plate of the sheet cassette supports the sheet guide member when the sheet cassette is attached to an apparatus body (a space).

The sheet guide member of the printer described above moves automatically to the sheet guide position by a bias force of the torsion spring. However, there is a case when the sheet guide member does not return to the sheet guide position due to a drop of resilience force of the torsion spring. If the sheet is conveyed in this state, jamming occurs again. In order to solve this problem, the abovementioned printer sets the sheet guide member at the correct sheet guide position by attaching the sheet cassette to the printer (the space).

However, the abovementioned printer has a problem that the sheet cannot be conveyed unless the sheet cassette is attached. For instance, the sheet cassette had to attach even if an image is to be formed on a sheet supplied from the manual tray. Therefore, there is a case when user's convenience in use is dropped. Still further, the printer described above is required to provide a device for detecting whether or not the sheet cassette has been attached to the apparatus body. Therefore, there have been problems that the structure of the printer is complicated and it requires extra cost.

SUMMARY

In accordance with an embodiment of the present disclosure, an image forming apparatus includes a first conveying path, a second conveying path, a detector, a conveyance guide member and an interlock mechanism. The first conveying path communicates the second conveying path through which a sheet supplied from a supply part is conveyed. The detector detects whether or not the sheet is present in the first conveying path. The conveyance guide member composes the second conveying path and one end part thereof is pivotally supported so as to be able to open/close the second conveying path. The interlock mechanism interlocks the detector with the opening/closing operation of the conveyance guide member. The detector detects the opening/closing operation of the conveyance guide member.

In accordance with an embodiment of the present disclosure, an image forming apparatus includes a second conveying path, a detector, a conveyance guide member and an interlock mechanism. The second conveying path is formed so that a sheet supplied from a supply part is conveyed. The detector detects whether or not the sheet held in the supply part is present. The conveyance guide member composes the second conveying path and one end part thereof is pivotally supported so as to be able to open/close the second conveying path. The interlock mechanism interlocks the detector with the opening/closing operation of the conveyance guide member. The detector detects the opening/closing operation of the conveyance guide member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A suitable embodiment of the present disclosure will be described below with reference to the attached drawings. It is noted that the following description will be made by assuming a front side of each drawing to be a front side of an image forming apparatus of the present embodiment and based on directions indicated in each drawing. Still further, such terms as 'upstream' and 'downstream' in the following description represent 'upstream', 'downstream' or the like in a conveying direction of a sheet S.

Figure 1:
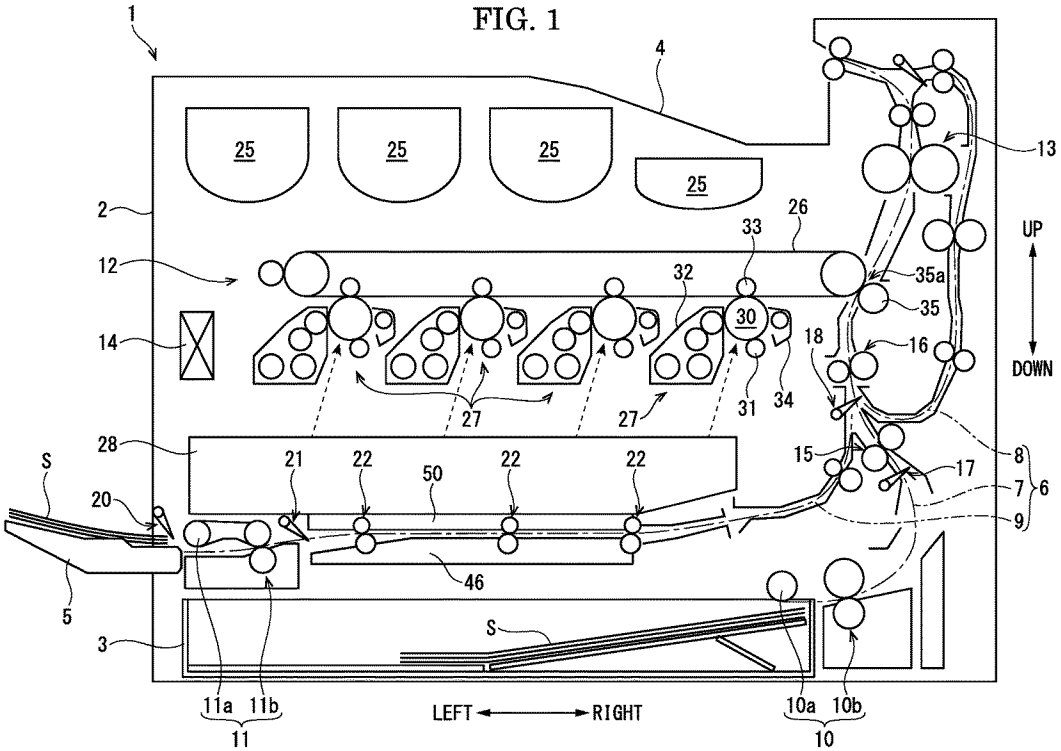
FIG. 1 is a sectional view schematically showing an inner structure of a color printer according to one embodiment of the present disclosure.
Figure 2:
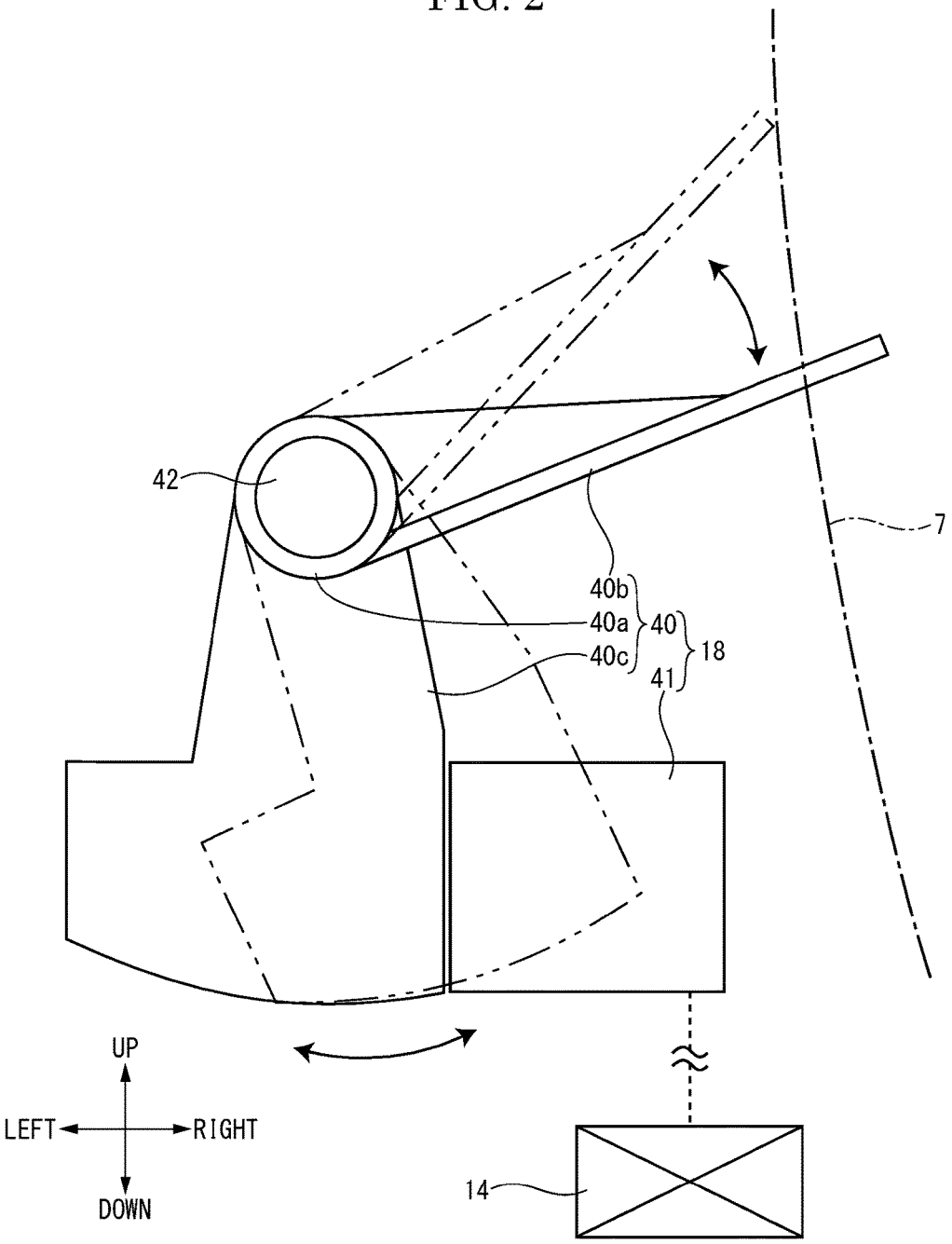
FIG. 2 is a front view schematically illustrating a second detector of the color printer of the first embodiment of the present disclosure.
Figure 3:
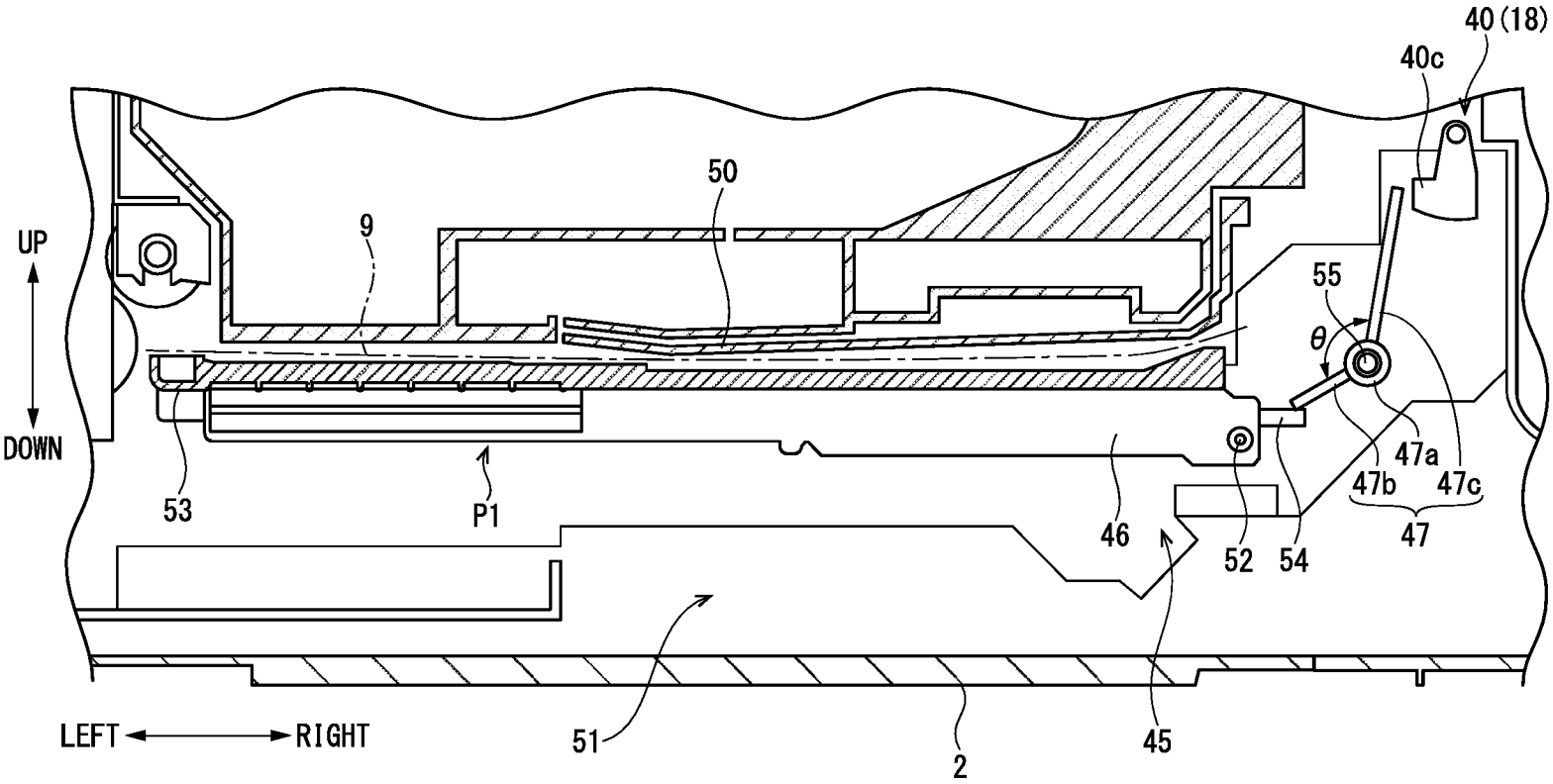
FIG. 3 is a section view schematically illustrating an unjamming structure of the color printer of the first embodiment of the present disclosure.
Figure 4:
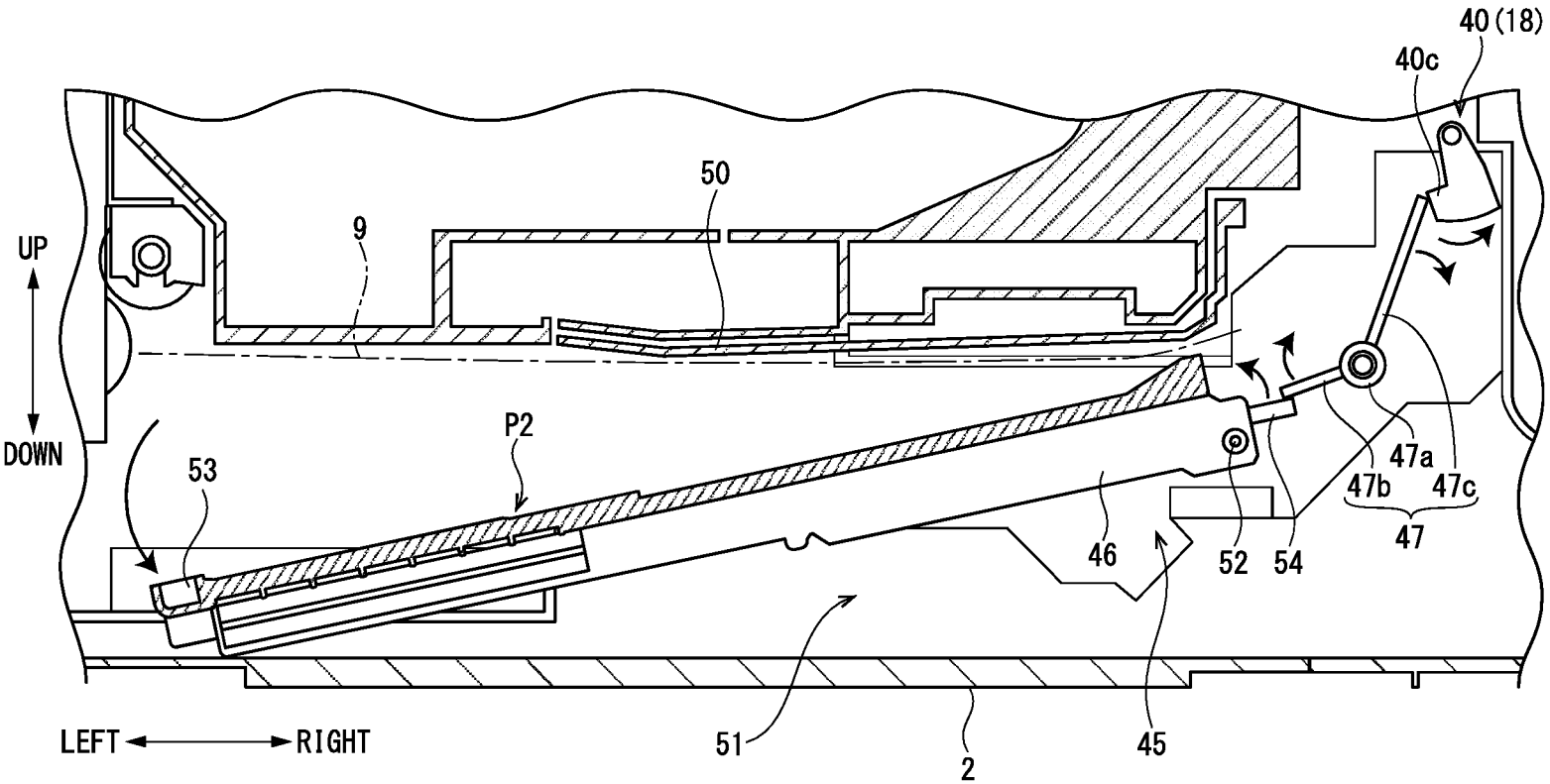
FIG. 4 is a section view schematically illustrating a state in which a conveyance guide member of the unjamming structure of the color printer of the one embodiment of the present disclosure.

With reference to FIGS. 1 through 4, a color printer 1 as an image forming apparatus will be described. FIG. 1 is a sectional view schematically showing an inner structure of the color printer 1. FIG. 2 is a front view schematically illustrating a second detector 18. FIG. 3 is a section view schematically illustrating an unjamming structure 45. FIG. 4 is a section view schematically illustrating a state in which a conveyance guide member 46 of the unjamming structure 45.

As shown in FIG. 1, the color printer 1 includes an apparatus body 2, a sheet feed cassette 3, a sheet discharge tray 4 and a manual tray 5. The apparatus body 2 is formed substantially into a shape of a box. The sheet feed cassette 3 as a cassette is provided drawably in a lower part of the apparatus body 2. The sheet discharge tray 4 is provided in a upper part of the apparatus body 2. The manual tray 5 is provided turnably on a left side surface of the apparatus body 2.

The sheet feed cassette 3 is formed approximately into a shape of rectangular box which is flat in a vertical direction. A sheet S (bundle of stacked sheets S) is stored in the sheet feed cassette 3. The sheet feed cassette 3 is configured to be able to be drawn out approximately in a horizontal direction (in a left direction for example). It is noted that the sheet S stored in the sheet feed cassette 3 is not limited to be a sheet of paper and may be a resin film, an OHP sheet, and the like.

The manual tray 5, i.e., a supply part, is configured to be able to turn between an erect position in which the manual tray 5 erects along the left side surface of the apparatus body 2 and a manual feed position in which the manual tray 5 turns outward and extends obliquely toward an upper left side. The sheet S is placed (held) on an upper surface of the manual feed tray 5 displaced to the manual feed position.

Still further, conveying paths 6 through which the sheet S is conveyed are formed within the apparatus body 2. The conveying paths 6 include a first conveying path 7, a reverse conveying path 8, and a second conveying path 9. The first conveying path 7 extends from the sheet feed cassette 3 to a sheet discharge tray 4. The reverse conveying path 8 is formed so as to communicate an upstream and a downstream of the first conveying path 7. The second conveying path 9 is formed so as to communicate the manual sheet feeding tray 5 with an upstream side of the first conveying path 7. It is noted that the respective conveying paths 7, 8, and 9 will be detailed later.

The color printer 1 also includes a first sheet feeding mechanism 10, a second sheet feeding mechanism 11, an image forming part 12, a fixing unit 13, and a control unit 14 within the apparatus body 2.

The first sheet feeding mechanism 10 is provided in upstream of the first conveying path 7. The second sheet feeding mechanism 11 is provided in upstream of the second conveying path 9. The image forming part 12 is provided at an intermediate part of the first conveying path 7. The fixing unit 7 is provided downstream of the first conveying path 7. The control unit 14 integrally controls the color printer 1.

The first sheet feeding mechanism 10 includes a pickup roller 10*a* and a conveying roller pair 10*b* (referred to also as a 'first roller group' hereinafter). The first roller group is rotationally driven by a driving source not shown. The sheet S stored in the sheet feed cassette 3 is delivered one by one to the first conveying path 7 by the rotating first roller group.

The first conveying path 7 extends in the vertical direction so as to communicate the sheet feed cassette 3 with the sheet discharge tray 4. The first conveying path 7 is provided with a conveying roller pair 15, a registration roller pair 16, and others. The conveying roller pair 15 is disposed downstream of the first sheet feeding mechanism 10. A first detector 17 detecting a passage of the sheet S is provided in a vicinity of an upstream side of the conveying roller pair 15. The registration roller pair 16 is disposed downstream of the conveying roller pair 15. The registration roller pair 16 is provided to temporarily stop the sheet S being conveyed through the first conveying path 7 to correct a skew of the sheet S (so-called skew correction). A second detector 18 detecting a passage of the sheet S is provided in a vicinity of an upstream side of the registration roller pair 16.

The reverse conveying path 8 is provided to print on both surfaces of the sheet S. The reverse conveying path 8 is diverged downstream the first conveying path 7 (downstream of the fixing unit 13) and extends downward. A downstream end of the reverse conveying path 8 joins the first conveying path 7 between the conveying roller pair 15 and the second detector 18.

The second sheet feeding mechanism 11 includes a pickup roller 11*a* and a conveying roller pair 11*b* (referred to also as a 'second roller group' hereinafter). The second roller group is rotationally driven by a driving source. A sheet S set on the manual tray 5 is delivered one by one to the second conveying path 9 by the second roller group. The second sheet feeding mechanism 11 is provided with a manual feed detector 20 detecting whether the sheet S exists on the manual tray 5.

The second conveying path 9 extends in a right direction from the manual tray 5 along an upper surface (upper part) of the sheet feed cassette 3. A third detector 21 detecting a passage of the sheet S is provided at an upstream end of the second conveying path 9. A plurality (three for example) of conveying roller pairs 22 is provided along the second conveying path 9. A downstream end of the second conveying path 9 joins the first conveying path 7 between the conveying roller pair 15 and the second detector 18.

The image forming part 12 includes four tonner containers 25, an intermediate transfer belt 26, four drum units 27 and an optical scanning device 28. The four toner containers 25 are arrayed in parallel in a left-right direction under the sheet discharge tray 4. The intermediate transfer belt 26 is disposed under the respective toner containers 25. The four drum units 27 are arrayed in parallel in the left-right direction under the intermediate transfer belt 26. The optical scanning unit 28 is disposed under the respective drum units 27.

The four tonner containers 25 house toners (developing agents) of four colors (yellow, magenta, cyan, black). The four drum units 27 are provided corresponding to the toners of the respective colors. Each of the drum units 27 includes a photosensitive drum 30, a charging device 31, a development device 32, a primary transferring roller 33, a cleaning device 34. Each drum unit 27 primarily transfers a toner image to the intermediate transfer belt 26. Disposed on a right side of the intermediate transfer belt 26 is a secondary transfer roller 35 forming a secondary transfer nip part 35*a*. The full-color toner image borne on the intermediate transfer belt 26 is secondarily transferred to a sheet S passing through the secondary transfer nip part 35*a*. The fixing unit 13 fixes the toner image on the sheet S. The sheet S which has undergone the fixing process is then discharged out to the sheet discharge tray 4.

By the way, the color printer 1 of the present embodiment is configured to detect jamming of the sheet S by using the respective detectors 17, 18, and 21 disposed along the respective conveying paths 7 and 9. It is noted that because the respective detectors 17, 18, and 21 are constructed approximately in the same manner, only the second detector 18 will be described below.

As shown in FIG. 2, the second detector 18 detects whether the sheet S exists within the first conveying path 7 in a vicinity of the registration roller pair 16. The second detector 18 also detects a conveyance failure of the sheet S at the registration roller pair 16. The second detector 18 includes an actuator 40 and a detecting part 41.

The actuator 40 is configured to be swingable (turnable) by coming into contact with the sheet S passing through the first conveying path 7. Specifically, the actuator 40 includes a rotational shaft part 40*a*, an abutment piece 40*b* and an operating part 40*c*.

The rotational shaft part 40*a* is rotatably supported by a shaft 42 fixed to the apparatus body 2. The abutment piece 40*b* is fixed to the rotational shaft part 40*a* and extends from the rotational shaft part 40*a* toward the first conveying path 7. The operating part 40*c* is fixed to the rotational shaft part 40*a* and extends from the rotational shaft part 40*a* toward the detecting part 41. The abutment piece 40*b* and the operating part 40*c* turn (swing) centering on the rotational shaft part 40*a*. The swingable operating piece part 40*c* switches ON/OFF of the detecting part 41. It is noted that a coil spring not shown is wound around the rotational shaft part 40*a* to bias the abutment piece 40*b* toward a position blocking the first conveying path 7.

The detecting part 41 is configured to be able to detect the swing (turn) of the actuator 40. More specifically, the detecting part 41 is a so-called photo-interrupter and includes a light emitting part and a light receiving part (both not shown) provided so as to face with each other. An optical path is formed between the light emitting part and the light receiving part. The operating part 40*c* described above is configured as a light blocking piece capable of advancing and receding to the part between the light emitting and receiving parts. It is noted that the detecting part 41 is electrically connected with the control unit 14 and transmits a light receiving signal to the control unit 14.

An operation of the second detector 18 will be described below. When no sheet S is conveyed, the abutment piece 40*b* is displaced to the position closing the first conveying path 7, and the operating part 40*c* is displaced at a position opening the optical path of the detecting part 41 (see a solid line in FIG. 2). That is, the detecting part 41 outputs a HIGH level light receiving signal (ON state).

Next, when the sheet S is conveyed, the abutment piece 40*b* is pushed by the sheet S being conveyed through the first conveying path 7 and turns toward a position opening the first conveying path 7 (see a two-dot chain line in FIG. 2). Along with the turn of the abutment piece 40*b*, the operating part 40*c* turns toward a position blocking the optical path of the detecting part 41. Thereby, the detecting part 41 outputs a LOW level light receiving signal (OFF state). Because the light receiving signal of the detecting part 41 is switched from the ON state to the OFF state, the control unit 14 perceives that the sheet S is present in the first conveying path 7.

The registration roller pair 16 is controlled by the control unit 14 and stops conveyance of the sheet S until a predetermined time elapses. Thereby, the sheet S deflects and a skew thereof is corrected. As the predetermined time elapses, the registration roller pair 16 is rotationally driven and sends the sheet S whose skew has been corrected downstream (to the secondary transfer nip part 35*a*). It is noted that a stop time (the predetermined time required for the skew correction) of the registration roller pair 16 is stored in a memory of the control unit 14 in advance.

When a rear end part of the sheet S passes through the second detector 18 (the registration roller pair 16), the abutment piece 40*b* and the operating part 40*c* return to their original positions. That is, the operating part 40*c* opens the optical path of the detecting part 41 and the detecting part 41 is turned into the ON state. It is noted that while the second detector 18 is turned ON state during when the conveyance of the sheet S is stopped and is turned into the OFF state during when the sheet S is conveyed, the present disclosure is not limited this configuration. For instance, the second detector 18 may be configured such that it is turned into the OFF state during when the conveyance of the sheet S is stopped and into the ON state during when the sheet S is conveyed.

If the sheet S is left in the registration roller pair 16 here, the detecting part 41 continues to output the LOW level light receiving signal (keeps the OFF state). If the detecting part 41 keeps the OFF state even after the elapse of the predetermined time, the control unit 14 perceives that the sheet S is jammed. The control unit 14 displays a message indicating that jamming has occurred around the registration roller pair 16 on a liquid crystal display not shown. It is noted that in the state in which jamming has occurred, the control unit 14 halts (prohibits) the execution of the image forming process including the conveyance of the sheet S. It is noted that if jamming occurs in the first conveying path 7, a user opens an opening door (not shown) provided on a right side surface of the apparatus body 2 to removed the jammed sheet S.

The color printer 1 of the present embodiment also includes an unjamming structure 45 to remove the sheet S jammed within the second conveying path 9.

As shown in FIGS. 3 and 4, the unjamming structure 45 includes a conveyance guide member 46 and an interlock mechanism 47. The conveyance guide member 46 composes a part of the second conveying path 9 and is configured to be able to open/close the second conveying path 9. The interlock mechanism 47 is configured to link the opening/closing operation of the conveyance guide member 46 with the second detector 18.

The conveyance guide member 46 composes the second conveying path 9 with a fixed guide member 50 fixed to the apparatus body 2. The fixed guide member 50 is formed approximately into a shape of a rectangular plate in a plan view. The fixed guide member 50 extends in the left-right direction along a lower surface of the optical scan unit 28 (see FIG. 1). The fixed guide member 50 rotatably supports upper side rollers of the respective conveying roller pairs 22 (see FIG. 1). The conveyance guide member 46 is also formed approximately into a shape of a rectangular plate in a plan view. The conveyance guide member 46 is provided below the fixed guide member 50 while interposing a gap (the second conveying path 9). The conveyance guide member 46 rotatably supports lower side rollers of the respective conveying roller pairs 22 (see FIG. 1). Formed under the conveyance guide member 46 is a space 51 for attaching the sheet feed cassette 3. That is, the second conveying path 9 extends approximately in a horizontal (left-right) direction between the sheet feed cassette 3 and the optical scan unit 28.

Formed at a right end part (downstream) of the conveyance guide member 46 is a turning shaft 52 axially supported by the apparatus body 2. The conveyance guide member 46 is configured to be able to turn (swing) in the vertical direction centering on the turning shaft 52 (see FIG. 4). More specifically, the conveyance guide member 46 is configured to be able to lift (move) between a closed position P1 where the conveyance guide member 46 composes a bottom surface of the second conveying path (see FIG. 3) and an opened position P2 where the conveyance guide member 46 is lowered toward the space 51 from which the sheet feed cassette 3 has been drawn out. That is, the conveyance guide member 46 is configured to open the second conveying path 9 by being moved from the closed position P1 to the opened position P2.

Formed on a left end part (upstream side) of the conveyance guide member 46 is an operating part 53 to be gripped by the user. The apparatus body 2 is provided with a lock mechanism (not shown) capable of locking the left end part of the conveyance guide member 46. The lock mechanism locks the left end part of the conveyance guide member 46 to keep the conveyance guide member 46 at the closed position P1.

The conveyance guide member 46 includes an engaging projection part 54 extending from a right end part of the conveyance guide member 46 toward the right side. The engaging projection part 54 is formed above the turning shaft 52 and on the right side (downstream) of (an axial center of) the turning shaft 52.

The interlock mechanism 47 is configured to be able to come in contact with the conveyance guide member 46 and the actuator 40. The interlock mechanism 47 includes an interlock axial part 47*a*, a first link part 47*b* and a second link part 47*c*.

The interlock axial part 47*a* is rotatably supported by a shaft 55 fixed to the apparatus body 2. The interlock axial part 47*a* is disposed at an upper right side of the engaging projection part 54. The first and second link parts 47*b* and 47*c* are formed approximately into a shape of a rod, respectively. The first and second link parts 47*b* and 47*c* extend in directions approximately opposite from each other and are fixed to the interlock axial part 47*a* such that an angle θ formed between them becomes an obtuse angle (90 degrees<θ<180 degrees).

More specifically, the first link part 47*b* extends from the interlock axial part 47*a* toward the engaging projection part 54 of the conveyance guide member 46. A tip part of the first link part 47*b* is in contact with an upper surface of the engaging projection part 54. Meanwhile, the second link part 47*c* extends from the interlock axial part 47*a* to the operating part 40*c* of the second detector 18. The second link part 47*c* extends to a position where a tip part thereof can come into contact with a left surface of the operating part 40*c*. The second link part 47*c* is formed to be longer than the first link part 47*b*. A torsion coil spring (not shown) biasing the second link part 47*c* in a direction (counterclockwise in FIG. 3) of separating from the operating part 40*c* is wound around the interlock axial part 47*a*. It is noted the tip part of the second link part 47*c* may be in contact with the left surface of the operating part 40*c*. It is also noted that there may be provided a stopper (not shown) restricting a rotation range of the interlock mechanism 47.

It is noted that the operating part 40*c* of the second detector 18, the engaging projection part 54 of the conveyance guide member 46, and the interlock mechanism 47 are provided at a front end side (or a rear end side) of the conveyance guide member 46 so as not interfere the conveyance of the sheet S.

Next, an operation of the unjamming structure 45 will be described below. When an image is to be formed on the sheet S set on the manual tray 5, the conveyance guide member 46 is displaced at the closed position P1 and composes the second conveying path 9 (see FIG. 3). Here, if the third detector 21 (see FIG. 1) continuously keeps the OFF state even after an elapse of the predetermined time, the control unit 14 perceives that jamming has occurred around the second sheet feeding mechanism 11. Then, the control unit 14 displays a message or the like indicating that jamming has occurred on the liquid crystal display not shown.

The user executes an unjamming process in accordance to instructions displayed on the liquid crystal display. The user opens the opening door of the apparatus body 2 to confirm that the sheet S is jammed. In succession, the user draws the sheet feed cassette 3 out of the apparatus body 2 and pulls the operating part 53 downward to turn the conveyance guide member 46 from the closed position P1 to the opened position P2 (see FIG. 4). This arrangement makes it possible to remove (unjam) the sheet S jammed in the second conveying path 9 by opening the conveyance guide member 46.

Here, when the conveyance guide member 46 is lowered from the closed position P1 to the opened position P2, the engaging projection part 54 turns upward (counterclockwise in FIG. 4) centering on the turning shaft 52. Along with the turn of the engaging projection part 54, the first link part 47*b* in contact with the upper surface of the engaging projection part 54 also turns upward (clockwise in FIG. 4) centering on the interlock axial part 47*a*. Meanwhile, the second link part 47*c* turns downward (clockwise in FIG. 4) centering on the interlock axial part 47*a*.

Then, the tip part of the second link part 47*c* comes in contact with the left surface of the operating part 40*c* of the actuator 40. By being pushed by the second link part 47*c*, the operating part 40*c* turns toward the position blocking the optical path of the detecting part 41. Accordingly, the detecting part 41 of the second detector 18 continuously outputs the LOW level light receiving signal (keeps the OFF state). That is, when the conveyance guide member 46 is moved from the closed position P1 to the opened position P2, the interlock mechanism 47 engages with the second detector 18 to cause the second detector 18 to detect that the sheet S is present in the first conveying path 7. Thereby, the control unit 14 continues to perceive that the sheet S is present in the first conveying path 7.

Next, after finishing the unjamming process, the user raises the conveyance guide member 46 from the opened position P2 to the closed position P1 (see FIG. 3). Then, the engaging projection part 54 turns downward (clockwise in FIG. 4) centering on the turning shaft 52. Along with the turn of the engaging projection part 54, the first and second link parts 47*b* and 47*c* turn counterclockwise in FIG. 4 centering on the interlock axial part 47*a*. Therefore, the tip part of the second link part 47*c* separates from (or releases pressure against) the left surface of the operating part 40*c* of the actuator 40. The operating part 40*c* returns to the position opening the optical path of the detecting part 41, and the detecting part 41 detects the ON state. Thereby, the control unit 14 perceives that no sheet S is present in the first conveying path 7 and releases the prohibition of conveyance of the sheet S. Finally, the user closes the opening door of the apparatus body 2.

It is thus possible to restart the image forming process (conveyance of the sheet S) using the sheet S set on the manual tray 5. Noted that it is not necessary to attach the sheet feed cassette 3 to the apparatus body 2 because the sheet S is supplied from the manual tray 5.

According to the color printer 1 of the present embodiment described above, the interlock mechanism 47 interlocks the conveyance guide member 46 with the second detector 18, so that the second detector 18 can detect whether the conveyance guide member 46 is opened or closed. Accordingly, the second detector 18 is used to detect both the sheet S around the registration roller pair 16 within the first conveying path 7 and the conveyance guide member 46 whether it is opened or closed. That is, it is possible to detect the two different objects to be detected by the single second detector 18. This arrangement makes it possible to simplify the structure required for the detection and to cut the cost.

Still further, according to the color printer 1 of the present embodiment, the second detector 18 detects what there is no sheet within the first conveying path 7 as a state by which the sheet S can be conveyed. Meanwhile, the second detector 18 detects what the sheet S is present in the first conveying path 7 as a state in which jamming has occurred. When the conveyance guide member 46 is displaced to the opened position P2, the second detector 18 engages (comes into contact) with the interlock mechanism 47 and detects that the sheet S is present in the first conveying path 7. For instance, if the user forgets to return the conveyance guide member 46 to the closed position P1, the detecting part 41 of the second detector 18 continues to detect the OFF state. Accordingly, because the second detector 18 detects an occurrence of jamming in the state in which the conveyance guide member 46 is opened, the conveyance of the sheet S is prohibited. This arrangement makes it possible to prevent the sheet S from being conveyed in the state in which the conveyance guide member 46 does not compose the second conveying path 9 (in the state in which the conveyance guide member 46 is forgotten to be closed). That is, it is possible to prevent jamming from occurring again. Still further, it is possible to call for attention that the conveyance guide member 46 is being forgotten to be closed to the user.

Still further, according to the color printer of the present embodiment, the user executes the unjamming process by lowering the conveyance guide member 46 to open the second conveying path 9 after drawing the sheet feed cassette 3 out of the apparatus body 2. The user returns the conveyance guide member 46 to the closed position P1 after executing the unjamming process, so that the second conveying path 9 is returned to the state of being capable of conveying the sheet S. This arrangement makes it possible to convey the sheet S supplied from the manual tray 5 through the second conveying path 9 without causing jamming even in the state in which the sheet feed cassette 3 is drawn out of the apparatus body 2. That is, because the sheet S can be conveyed regardless whether or not the sheet feed cassette 3 is present, it is possible to provide the color printer 1 which is convenient to use for the user.

As described above, the interlock mechanism 47 turns corresponding to the opening/closing operation of the conveyance guide member 46 and swings the actuator 40. That is, a force opening/closing the conveyance guide member 46 is transmitted to the actuator 40 through the interlock mechanism 47. This arrangement makes it possible to accurately link the conveyance guide member 46 with the actuator 40. Accordingly, it is possible to detect the sheet S within the first conveying path 7 and to detect whether the conveyance guide member 46 is opened or closed by the single second detector 18.

It is noted that while the interlock mechanism 47 of the color printer 1 of the present embodiment actuates the second detector 18 corresponding to the opening/closing operation of the conveyance guide member 46, the present disclosure is not limited to this configuration. The interlock mechanism 47 may actuate the first detector 17 or the third detector 21 corresponding to the opening/closing operation of the conveyance guide member 46. In this case, the second link part 47*c* of the interlock mechanism 47 is configured to be able to engage (contact) with the first detector 17 or the third detector 21.

Figure 5:
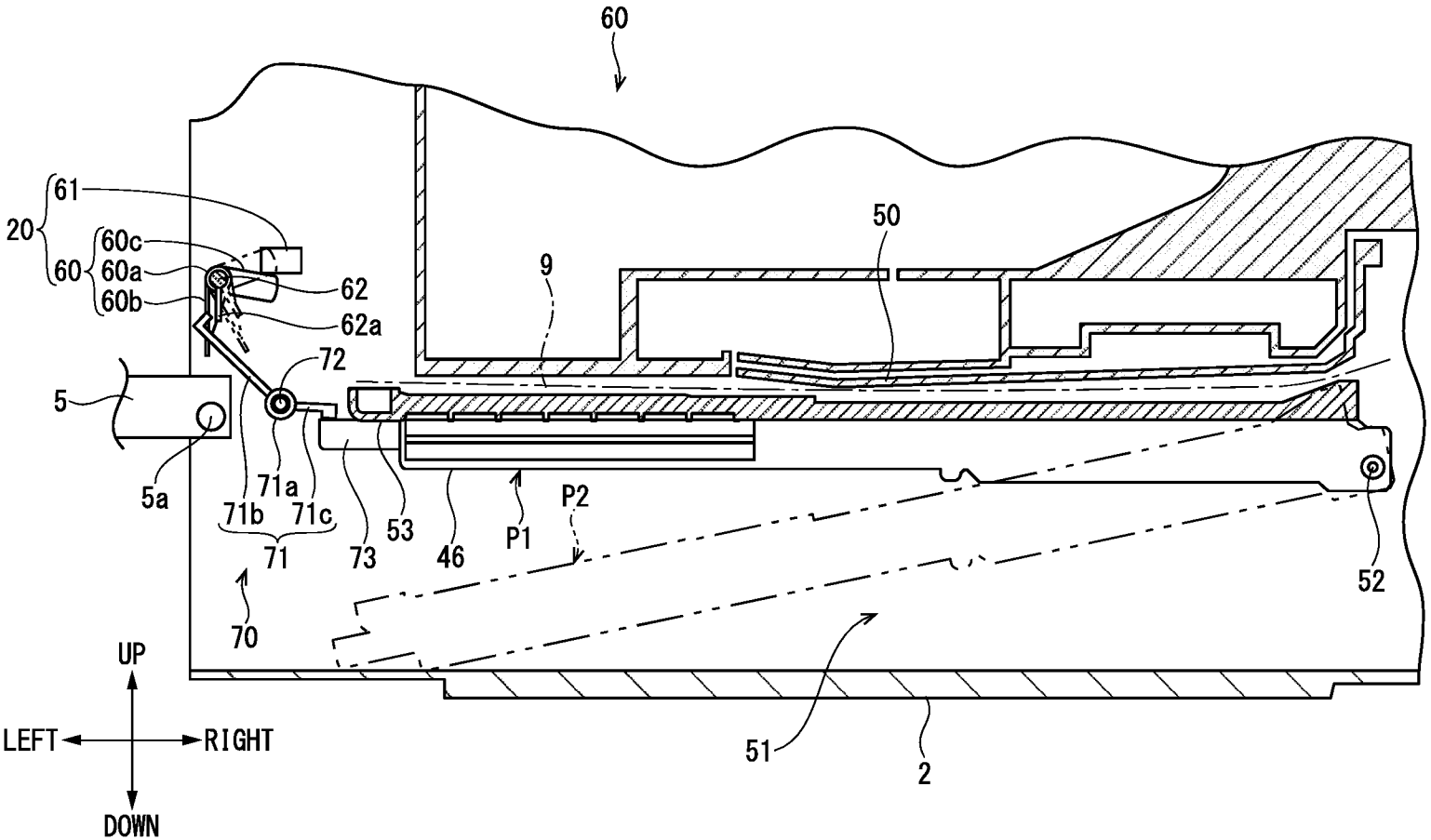
FIG. 5 is a section view schematically illustrating an unjamming structure of a color printer of a modified example of the present embodiment of the present disclosure.
Figure 6:
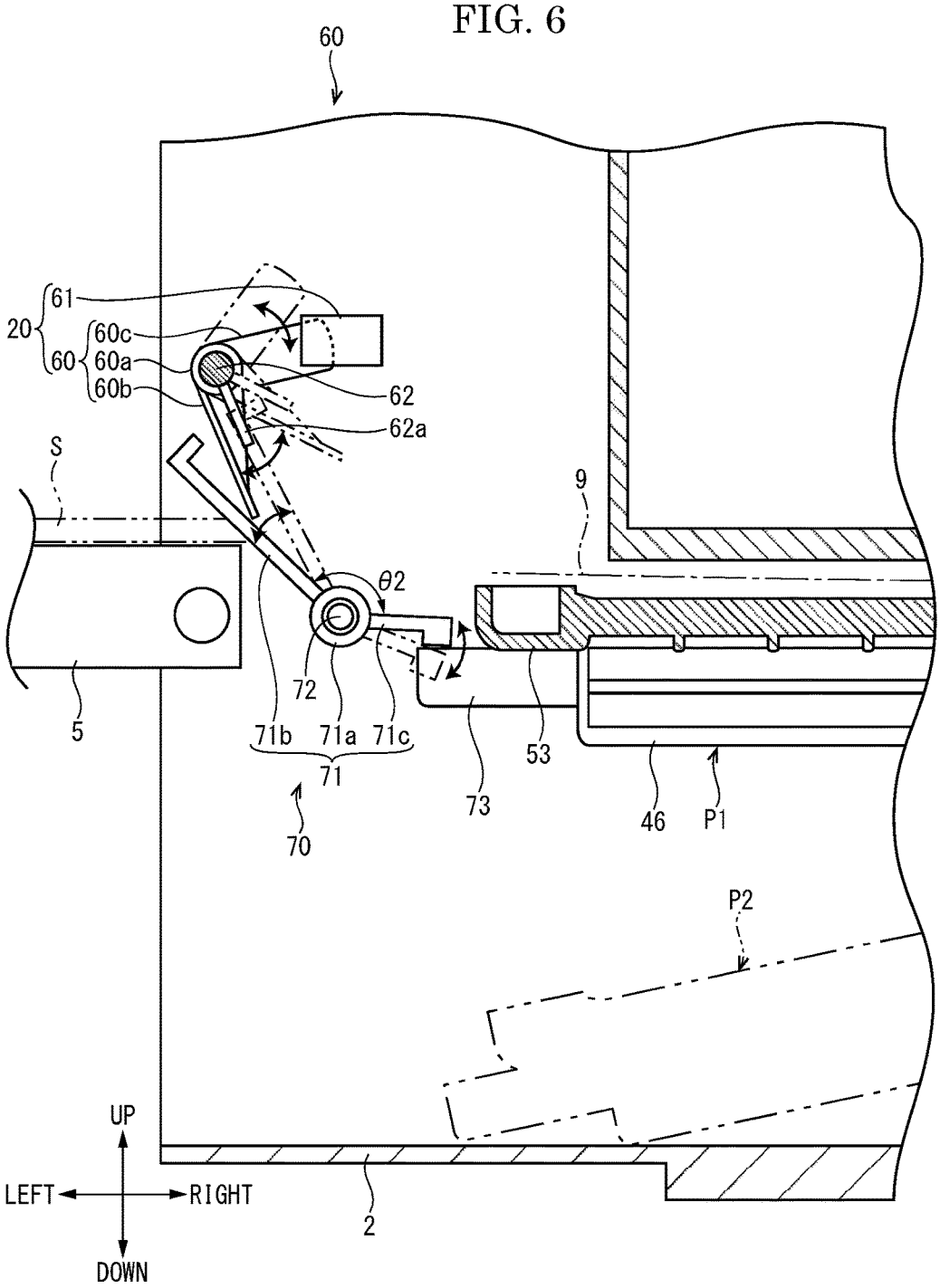
FIG. 6 is a section view schematically illustrating a part of the unjamming structure of the color printer of the modified example of the one embodiment of the present disclosure.

Still further, as shown in FIGS. 5 and 6, as a color printer 59 of a modified example of the present embodiment, an interlock mechanism 71 may be engaged with a manual feed detector 20 detecting whether or not the sheet S held on the manual tray 5 is present. The manual feed detector 20 and an unjamming structure 70 (the interlock mechanism 71) of the color printer 59 of the modified example of the present embodiment will be described below. It is noted that the same components with those of the color printer 1 described above will be denoted by the same or corresponding reference numerals and an explanation thereof will be omitted here.

The manual feed detector 20 is provided at an upstream end of the second conveying path 9 within the apparatus body 2. The manual feed detector 20 is provided above a turning part 5*a* of the manual tray 5 at approximately a center part in a front-back direction of the manual tray 5. The manual feed detector 20 is constructed approximately in the same manner with the second detector 18 and others described above and includes an actuator 60 and a detecting part 61.

The actuator 60 includes an abutment piece 60*b* and an operating piece 60*c* (light shielding piece) turning (swinging) centering on the turning shaft part 60*a*. Ina state in which there is no sheet S on the manual tray 5, the abutment piece 60*b* extends downward approximately perpendicularly from the turning shaft part 60*a* (see a solid line in FIG. 5). The operating piece 60*c* opens an optical path of the detecting part 61, and the detecting part 61 outputs a HIGH level light receiving signal (ON state). Meanwhile, when the sheet S is set on the manual tray 5, the abutment piece 60*b* is pushed in the right direction and turns counterclockwise in FIG. 5 (see a two-dot chain line in FIG. 5 and a solid line in FIG. 6). The operating piece 60*c* blocks the optical path of the detecting part 61, and the detecting part 61 outputs a LOW level light receiving signal (OFF state).

The turning shaft part 60*a* of the actuator 60 is fixed to a rear end side of the manual feed side shaft 62 extending in the front-rear direction. The manual feed side shaft 62 is supported rotatably by the apparatus body 2. A front end part of the manual feed side shaft 62 is displaced in a vicinity of a front end part of the conveyance guide member 46. A link piece 62*a* is fixed at a front end part of the manual feed side shaft 62. The interlock piece 62*a* extends downward in a radial direction of the manual feed side shaft 62.

The interlock mechanism 71 includes an interlock shaft part 71*a*, a first link part 71*b* and a second link part 71*c*.

The interlock shaft part 71*a* is rotatably supported by a shaft 72 fixed to the apparatus body 2. The interlock shaft part 71*a* (the shaft 72) is disposed under the manual feed side shaft 62 in a front view. The first and second link parts 71*b* and 71*c* extend in directions approximately opposite from each other and are fixed to the interlock shaft part 71*a* such that an angle θ2 formed between them becomes an obtuse angle (90 degrees<θ2<180 degrees) (see FIG. 6). The first link part 71*b* extends toward a front side of the interlock piece 62*a* of the manual feed side shaft 62 from the interlock shaft part 71*a*. The second link part 71*c* extends in the right direction from the interlock shaft part 71*a* in a front view. The second link part 71*c* is formed to be shorter than the first link part 71*b*. It is noted that a torsion coil spring not shown is wound around the interlock shaft part 71*a* to bias the first link part 71*b* in a direction of coming into contact with the interlock piece 62*a* (clockwise in FIGS. 5 and 6). It is noted that a stopper (not shown) restricting a rotation range of the interlock mechanism 71 may be provided.

A pressing part 73 is formed at a front side of the left end part of the conveyance guide member 46. In a state in which the conveyance guide member 46 is displaced to the closed position P1, the pressing part 73 is contact with a lower side of the second link part 71*c*. The second link part 71*c* is pressed upward by the pressing part 73. Therefore, the first link part 71*b* is kept at a position separated forward from the interlock piece 62*a* while resisting against a bias force of the torsion coil spring.

Next, an operation of the unjamming structure (the conveyance guide member 46, the interlock mechanism 71 and others) will be described with reference mainly to FIG. 6. It is noted that the following description will be made by assuming that the sheet S is stacked on the manual tray 5. It is also noted that the operations of the unjamming structure 70 similar to those of the unjamming structure 45 will be omitted here.

When the conveyance guide member 46 is lowered from the closed position P1 to the opened position P2, the pressing part 73 separates downward from the second link part 71*c* (see a two-dot chain line in FIGS. 5 and 6). Then, the interlock mechanism 71 turns clockwise centering on the interlock shaft part 71*a* by being biased by the torsion coil spring. Therefore, the first link part 71*b* of the interlock mechanism 71 presses the front surface of the interlock piece 62*a* and turns the manual feed side shaft 62 counterclockwise in FIG. 6. Then, the operating piece 60*c* of the manual feed detector 20 turns further counterclockwise in FIG. 6 from the state in which the operating piece 60*c* blocks the optical path of the detecting part 61 and passes through (separates) between the light emitting part and the light receiving part of the detecting part 61. Thereby, the optical path of the detecting part 61 is opened, and the detecting part 61 continues to output a HIGH level light receiving signal (keeps the ON state). As described above, the interlock mechanism 71 engages with the manual feed detector 20 and causes the manual feed detector 20 to detect that there is no sheet S on the manual tray 5 when the conveyance guide member 46 is moved from the closed position P1 to the opened position P2. Thereby, the control unit 14 perceives that there is no sheet S on the manual tray 5 and continues to prohibit the conveyance of the sheet S.

Next, when the user lifts the conveyance guide member 46 from the opened position P2 to the closed position P1 after executing the unjamming process, the pressing part 73 presses the second link part 71*c* from the underneath (see a solid line in FIGS. 5 and 6). Then, the interlock mechanism 71 turns counterclockwise in FIG. 6 centering on the interlock shaft part 71*a* by resisting against a bias force of the torsion coil spring. Due to that, the first link part 71*b* of the interlock mechanism 71 separates forward from the interlock piece 62*a*. Then, the actuator 60 turns clockwise in FIG. 6 by its own weight, and the operating piece 60*c* enters between the light emitting part and the light receiving part of the detecting part 61. Thereby, the optical path of the detecting part 61 is blocked, and the detecting part 61 outputs the LOW level light receiving signal (keeps the OFF state).

According to the color printer 59 of the modified example of the present embodiment, the interlock mechanism 71 interlocks the conveyance guide member 46 with the manual feed detector 20. Therefore, the manual feed detector 20 is used for both directions of the sheet Son the manual tray 5 on the opening/closing operation of the conveyance guide member 46. That is, it is possible to detect the two objects to be detected by the single manual feed detector 20. This arrangement makes it possible to simplify the structure required for the detections and to cut the cost thereof.

Still further, according to the color printer 59 of the present embodiment, the manual feed detector 20 detects what there is the sheet S on the manual tray 5 as a state by which the sheet S can be conveyed. Meanwhile, the manual feed detector 20 detects what there is no the sheet S on the manual tray 5 as a state by which the sheet S can't be conveyed. When the conveyance guide member 46 is displaced to the opened position P2, the manual feed detector 20 engages with the interlock mechanism 71 and detects that there is not the sheet S on the manual tray 5. Accordingly, in the state in which the conveyance guide member 46 is opened, the conveyance of the sheet S is prohibited. This arrangement makes it possible to prevent the sheet S from being conveyed in the state in which the conveyance guide member 46 does not compose the second conveying path 9. That is, it is possible to prevent jamming from occurring again.

It is noted that while the sheet feed cassette 3 of the color printer 1 and 59 of the present embodiment (including the modified example) is drawn out of the apparatus body 2 in the left direction, the present disclosure is not limited to such configuration. For instance, the sheet feed cassette 3 may be drawn out in the right direction or in the front side (or the back side). Still further, while the conveyance guide member 46 is turned centering on the turning shaft 52 at the right end part to lift the left side thereof, the present disclosure is not limited to such configuration. For instance, the turning shaft 52 of the conveyance guide member 46 may be provided on the left end side or the front side (or the back side).

Still further, the case in which the present disclosure is applied to the color printer 1, 59 as one example has been described in the present embodiment, the present disclosure is not limited to such case, and the present disclosure is applicable also to a multi-function printer, a facsimile, a monochrome printer, and the like.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus, comprising:

a first conveying path through which a sheet is conveyed;

a second conveying path through which a sheet supplied from a supply part is conveyed and communicating with the first conveying path;

a detector configured to detect whether or not the sheet is present in the first conveying path;

a conveyance guide member configured to compose the second conveying path, one end part thereof being pivotally supported, and capable of opening/closing the second conveying path; and an interlock mechanism configured to interlock the detector with the opening/closing operation of the conveyance guide member, wherein the detector detects the opening/closing operation of the conveyance guide member, the image forming apparatus further comprises a registration roller pair temporarily for stopping the sheet being conveyed in the first conveying path to correct a skew of the sheet;

the detector detects a conveyance failure of the sheet at the registration roller pair.

2. The image forming apparatus according to claim 1, wherein the conveyance guide member is movable between a closed position where the conveyance guide member composes the second conveying path and an opened position where the second conveying path is opened; and the interlock mechanism engages with the detector to cause the detector to detect that the sheet is present in the first conveying path when the conveyance guide member is moved from the closed position to the opened position.

3. The image forming apparatus according to claim 2, further comprising a sheet feed cassette configured to store the sheet and removably attached into a space of an apparatus body, wherein the second conveying path is provided along an upper surface of the sheet feed cassette attached to the space from a manual tray as the supply part provided on a side surface of the apparatus body, and the conveyance guide member is liftable between the closed position where the conveyance guide member composes a bottom surface of the second conveying path and the opened position where the conveyance guide member is lowered to the space from which the sheet feed cassette has been drawn out of the apparatus body.

4. An image forming apparatus, comprising:

a first conveying path through which a sheet is conveyed;

a second conveying path through which a sheet supplied from a supply part is conveyed and communicating with the first conveying path;

a detector configured to detect whether or not the sheet is present in the first conveying path;

a conveyance guide member configured to compose the second conveying path, one end part thereof being pivotally supported, and capable of opening/closing the second conveying path; and an interlock mechanism configured to interlock the detector with the opening/closing operation of the conveyance guide member, wherein the detector detects the opening/closing operation of the conveyance guide member, the detector comprises:

an actuator configured to swing by coming into contact with the sheet passing through the first conveying path; and a detecting part configured to detect the swing of the actuator:

the interlock mechanism is configured to be able to come into contact with the conveyance guide member and the actuator, turns corresponding to an opening/closing operation of the conveyance guide member and swings the actuator.

5. The image forming apparatus according to claim 4, wherein the actuator comprises:

a rotational shaft part rotatably supported by an apparatus body; and an abutment piece configured to extend from the rotational shaft part to the first conveying path;

an operating part configured to extend from the rotational shaft part toward the detecting part:

wherein the interlock mechanism comprises:

an interlock axial part rotatably supported by the apparatus body;

a first link part configured to extend from the interlock axial part and linked with the conveyance guide member; and a second link part configured to extend from the interlock axial part in a direction different from that of the first link part and linked with the actuator:

an angle formed between the first and second link parts is an obtuse angle.

6. An image forming apparatus comprising:

a second conveying path through which a sheet supplied from a supply part is conveyed;

a detector configured to detect whether or not the sheet held in the supply part is present;

a conveyance guide member configured to compose the second conveying path, one end part thereof being pivotally supported, and capable of opening/closing the second conveying path; and an interlock mechanism configured to interlock the detector with the opening/closing operation of the conveyance guide member;

wherein the detector detects the opening/closing operation of the conveyance guide member, the conveyance guide member is movable between a closed position where the conveyance guide member composes the second conveying path and an opened position where the second conveying path is opened, the interlock mechanism engages with the detector to cause the detector to detect that there is no sheet in the supply part when the conveyance guide member is moved from the closed position to the opened position, the image forming apparatus further comprises a sheet feed cassette for storing the sheet and removably attached into a space of an apparatus body, the second conveying path is provided along an upper surface of the sheet feed cassette attached to the space from a manual tray as the supply part provided on a side surface of the apparatus body, the conveyance guide member is liftable between the closed position where the conveyance guide member composes a bottom surface of the second conveying path and the opened position where the conveyance guide member is lowered to the space from which the sheet feed cassette has been drawn out of the apparatus body.

7. An image forming apparatus, comprising:

a second conveying path through which a sheet supplied from a supply part is conveyed;

a detector configured to detect whether or not the sheet held in the supply part is present;

a conveyance guide member configured to compose the second conveying path, one end part thereof being pivotally supported, and capable of opening/closing the second conveying path; and an interlock mechanism configured to interlock the detector with the opening/closing operation of the conveyance guide member, wherein the detector detects the opening/closing operation of the conveyance guide member, the detector comprises:

an actuator configured to swing by coming into contact with the sheet passing through the second conveying path; and a detecting part configured to detect the swing of the actuator:

the interlock mechanism is configured to be able to come into contact with the conveyance guide member and the actuator, turns corresponding to an opening/closing operation of the conveyance guide member and swings the actuator.

8. The image forming apparatus according to claim 7, wherein the actuator comprises:

a rotational shaft part rotatably supported by an apparatus body; and an abutment piece configured to extend from the rotational shaft part to the second conveying path;

an operating part configured to extend from the rotational shaft part toward the detecting part:

wherein the interlock mechanism comprises:

an interlock axial part rotatably supported by the apparatus body;

a first link part configured to extend from the interlock axial part and linked with the conveyance guide member; and a second link part configured to extend from the interlock axial part in a direction different from that of the first link part and linked with the actuator:

an angle formed between the first and second link parts is an obtuse angle.

* * * * *